United States Patent [19]

Li

[11] 4,261,705

[45] Apr. 14, 1981

[54] SYSTEM AND METHOD FOR HANDLING LOCK GAS IN A COAL GASIFIER SYSTEM

[75] Inventor: Tsan-Chin Li, Macungie, Pa.

[73] Assignee: General Electric Company, Schenectady, N.Y.

[21] Appl. No.: 152,739

[22] Filed: May 23, 1980

[51] Int. Cl.[3] ..... C10J 3/50

[52] U.S. Cl. ..... 48/86 R; 48/87; 48/210; 406/48; 406/146; 414/217

[58] Field of Search ..... 48/86 R, 87, 77, 76, 48/210, 202, 197 R, 101; 266/159; 137/255, 565, 572; 220/85 S; 222/373, 394, 395; 414/217; 406/146, 48

[56] References Cited

U.S. PATENT DOCUMENTS

| | | | |
|---|---|---|---|
| 2,094,946 | 10/1937 | Hubman | 48/202 |
| 2,338,606 | 1/1944 | Voorhees | 422/219 |
| 2,925,334 | 2/1960 | Henze et al. | 48/86 R |
| 3,762,773 | 10/1973 | Schroeder | 406/146 |
| 3,994,418 | 11/1976 | Andersson | 48/86 R |
| 4,036,606 | 7/1977 | Zimmerman et al. | 48/77 |
| 4,070,161 | 1/1978 | Harter | 48/210 |

*Primary Examiner*—S. Leon Bashore
*Assistant Examiner*—Michael Goldman
*Attorney, Agent, or Firm*—Donald M. Winegar; H. H. Green, Jr.

[57] ABSTRACT

An apparatus for handling lock gas which enters a charging lockhopper from a fixed bed coal gasifier vessel includes a separator having a fluid inlet, a gas outlet and a drain. After a charging operation, a pump floods the lockhopper with water under pressure to force the lock gas through the fluid inlet to the separator without loss of gas pressure. When rising water is sensed in the separator, the pump is deactivated and drain valves are opened to drain water from the separator and lockhopper back into a storage tank. The lock gas leaves the separator under pressure and may be applied to gas cleanup equipment.

10 Claims, 1 Drawing Figure

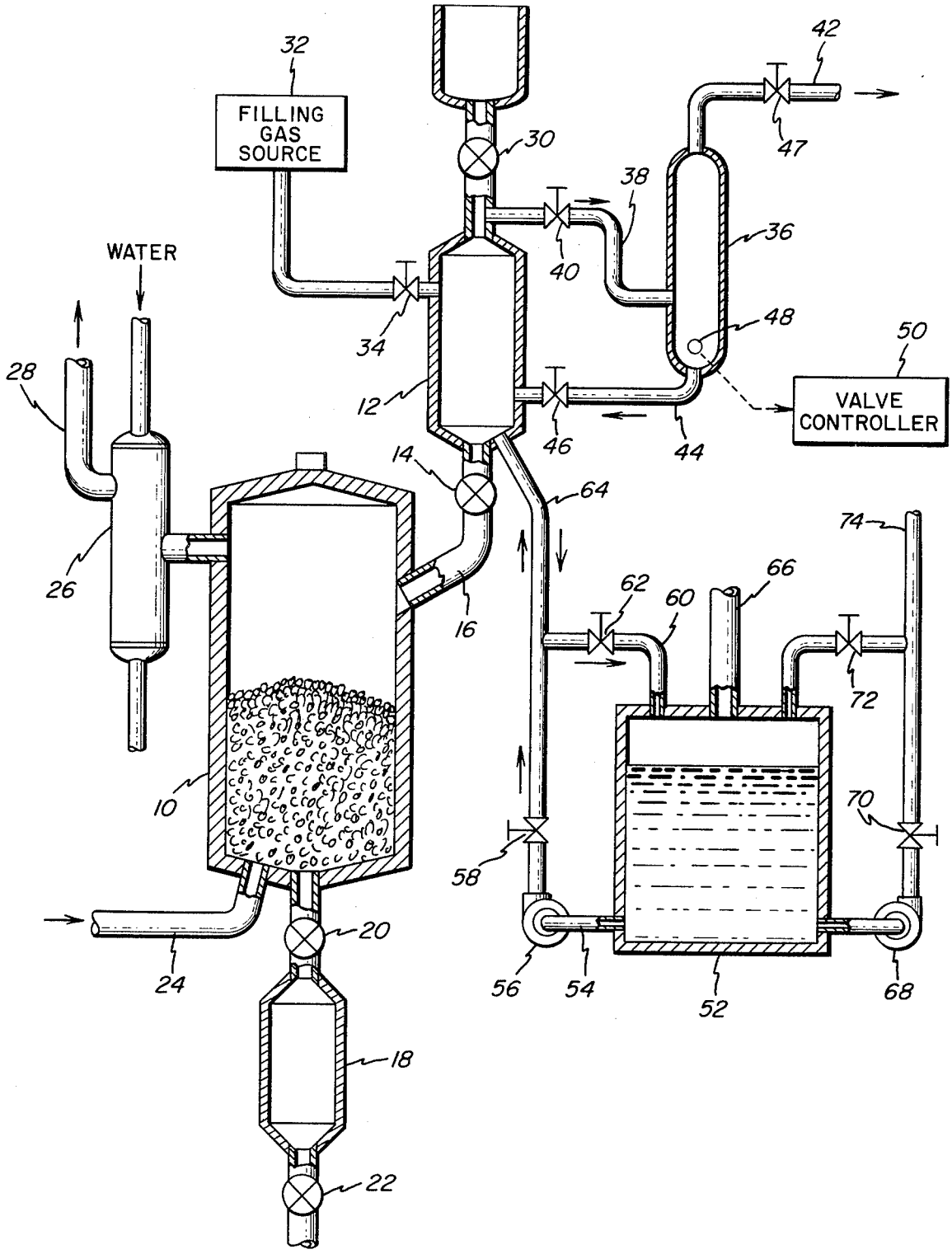
FILLING GAS SOURCE
WATER
VALVE CONTROLLER
32
42
30
47
38
36
40
48
50
34
28
12
46
44
14
64
74
26
62
60
66
16
72
10
70
58
20
24
56
54
52
68
18
22

SYSTEM AND METHOD FOR HANDLING LOCK GAS IN A COAL GASIFIER SYSTEM

This application describes and claims the same subject matter of U.S. application Ser. No. 904,604 filed May 10, 1978 now abandoned.

BACKGROUND OF THE INVENTION

The present invention relates to coal gasification and more particularly to an improved method and system for handling lock gas generated during operation of a coal gasifier.

In the fixed bed coal gasification process, coal is loaded or charged into the gasifier vessel at its upper end. Each new charge lands on previously-deposited charges. Steam and an oxidizing gas are admitted at the lower end of the gasifier vessel. Combustion occurring near the bottom of the gasifier vessel consumes some of the coal while the rest of the coal is gasified to yield a raw gas.

In one type of fixed bed coal gasification process, a relatively constant superatmospheric pressure is maintained in the gasifier vessel. In a pressurized gasifier system, coal may be introduced into the gasifier by means of a charging lock or lockhopper arrangement. A quantity or charge of coal is loaded into the lockhopper at atmospheric pressure while the lockhopper is sealed from the gasifier vessel. After the lockhopper is fully loaded, the lockhopper internal pressure is elevated by a high pressure filling gas until it is on the order of or slightly greater than the gasifier vessel interior pressure. A coal-carrying filling tube between the lower end of the lockhopper and the upper end of the gasifier vessel is then opened to allow the coal to be charged into the vessel.

As the coal is introduced into the gasifier vessel through the filling tube, gas generated within the vessel rises through the filling tube into the lockhopper. This gas is generally referred to as lock gas although its chemical composition is substantially the same as the raw gas which the gasifier vessel is intended to produce.

Since the lockhopper has to be at atmospheric pressure before coal can be loaded into it, the accumulated lock gas must be disposed of before the next loading operation. The simplest way to dispose of lock gas is to exhaust it into the atmosphere as the lockhopper is being depressurized. This method, while simple, is unacceptable for at least two reasons. First, the lock gas contains elements such as sulphur compounds which would contribute to atmospheric pollution if exhausted without treatment. Second, since the lock gas has substantially the same composition as any gas generated within the gasifier vessel, simply exhausting it into atmosphere is a complete waste of its energy potential.

It has been suggested that lock gas might be used as an incinerator fuel. However, there is concern that burning untreated lock gas might contribute to atmospheric pollution. Moreover, the pressure of lock gas exhausted from the lockhopper during depressurization fluctuates widely and nonuniformly. Additionally, each gasifier has its own gas generating characteristics. This lack of uniformity among gasifiers, which may have a common lock gas handling system, and the widely fluctuating lock gas pressure from any one gasifier further tend to discourage use of lock gas as an incinerator fuel.

It has also been suggested that expanded or low pressure lock gas might be re-compressed and applied to gas cleanup equipment along with raw gas generated in the gasifier vessel. However, since the pressure of expanded lock gas is on the order of atmospheric pressure or 14.7 pounds per square inch while the raw gas pressure is on the order of 330 pounds per square inch, a considerable amount of energy must be expended in re-compressing the lock gas. This reduces the overall efficiency of the coal gasification process.

SUMMARY OF THE INVENTION

The present invention is a system and method for removing lock gas from the lockhopper without substantial loss of gas pressure.

A lock gas handling system constructed in accordance with the present invention is intended to be used in a coal gasifier system of the type having a gasifier vessel, a lockhopper for receiving coal to be charged into the gasifier and means for pressurizing the lockhopper prior to charging. The lock gas handling system includes a separator having a controllable fluid inlet from the lockhopper, a controllable fluid drain and a gas outlet. A liquid storage tank is connected to the lockhopper. Liquid can be pumped from the reservoir into the lockhopper at the conclusion of a charging operation to force lock gas through the separator to the gas outlet under pressure. The system further includes means responsive to the presence of liquid in the separator to terminate the pumping operation and to open the controllable fluid drain. Both the lockhopper and the separator are drained of liquid before more coal is loaded into the lockhopper.

DESCRIPTION OF THE DRAWING

While the specification concludes with claims particularly pointing out and distinctly claiming that which is regarded as the present invention, further details of a preferred embodiment of the invention may be more readily ascertained from the following detailed description when read in conjunction with the accompanying schematic drawing of a coal gasifier system including apparatus embodying the present invention.

DETAILED DESCRIPTION

Referring to the drawing, a fixed bed gasifier vessel 10 receives coal through a charging arrangement which includes a lockhopper 12, and other components described later. Ash resulting from burning of this coal vessel is discharged from the gasifier vessel 10 through a second ash lockhopper 18 connected to the bottom of the vessel 10 through a valve 20. A second valve 22 is located in a discharge tube from the ash lockhopper 18. To maintain vessel pressure when disposing of ash, one of the valves 20 and 22 is always closed. More specifically, if valve 22 is opened to discharge accumulated ash from the lockhopper 18, then valve 20 remains closed. If valve 20 is opened to allow more ash to enter the lockhopper 18 from the vessel 10, then valve 22 remains closed.

Steam and an oxidizing gas, such as air or oxygen, is applied to the vessel 10 through an inlet pipe 24 which enters the vessel 10 at the bottom wall.

Gas generated during operation of the gasifier vessel, referred to as raw gas, is quenched with water in a quenching chamber 26 before being applied to gas cleanup equipment through an outlet conduit 28.

In addition to lockhopper 12, the charging apparatus includes an inlet valve 30, an outlet valve 14 and a filler tube 16 leading into the gasifier vessel 10. Like the corresponding valves of the ash lockhopper, at least one of the valves 14 and 30 is always closed to avoid loss of pressurization within the gasifier vessel 10. More specifically, when valve 30 is opened to admit more coal to the lockhopper 12, valve 14 remains closed. Conversely, if valve 14 is opened to charge coal from the lockhopper 12 into the gasifier vessel 10, then valve 30 remains closed.

When coal is being loaded into lockhopper 12 through open valve 30, the interior of the lockhopper is at atmospheric pressure or 14.7 pounds per square inch. The gasifier vessel 10 on the other hand operates at a superatmospheric pressure, which, in one embodiment of the invention, may be on the order of 330 pounds per square inch. In order to charge coal into gasifier vessel 10, the lockhopper 12 is pressurized prior to charging by means of a filling gas provided from a source 32 through a valve 34. The filling gas elevates the pressure within the lockhopper 12 to a level equal to or slightly greater than the operatlng pressure of the gasifier vessel 10. It is necessary, of course, that all inlet and outlet connections to lockhopper 12, other than the connection to filling gas source 32, be closed at the time of pressurization.

When pressurization is complete, valve 34 is closed to disconnect the filling gas source 32. Valve 14 is opened to allow coal in the pressurized lockhopper 12 to be introduced into the vessel 10 through tube 16. As the coal enters the vessel 10, a raw gas rises through tube 16 and valve 14 causing the lockhopper 12 to be charged with lock gas at a pressure on the order of the pressure within the gasifier vessel 10.

The accumulated lock gas is removed from the system without significant loss in gas pressure by the operation of the improved apparatus described below.

The improved apparatus includes a gas separator 36 having a fluid inlet line 38 with a valve 40, a gas outlet line 42 preferably connected to gas cleanup equipment (not shown) and a drain line 44 which may be selectively connected to the interior of lockhopper 12 through a valve 46. A valve 47 is located in the outlet line 42. The separator 36 includes a liquid level detector 48 located near the bottom wall of the separator chamber. The detector 48 may be connected to a valve controller unit 50 which would basically be an event-triggered timing circuit for controlling the various valves in the lock gas handling system in a manner to be described below.

The apparatus further includes a storage tank 52 for a pressurizing liquid, preferably water. The tank 52 has an outlet 54 to a pump 56, the discharge side of which is connected to a valve 58. The tank 52 further includes a drain inlet 60 having a valve 62. A single pipe 64 is connected between one side of each of the valves 58 and 62 and the lower end of the lockhopper 12.

The operation of the lock gas handling system during a complete charging cycle is described below. For purposes of illustration, it is assumed that the cycle begins with lockhopper 12 at atmospheric pressure and only valve 30 open. Pump 56 is inoperable.

After the lockhopper 12 has been filled with coal admitted through the open valve 30, valve 30 is closed and valve 34 is opened to admit pressurizing gas from source 32 into the lockhopper 12. When the pressure within the lockhopper 12 has been raised to a level equal to or slightly greater than the pressure within the gasifying vessel 10, valve 34 is closed and valve 14 is opened to allow coal to be introduced into the vessel 10. When lockhopper 12 has been emptied of its charge of coal, valve 14 is closed with a quantity of lock gas being trapped in the lockhopper 12.

To remove this lock gas from the system without loss in gas pressure, valves 40 and 58 are opened and pump 56 is activated to force water from the tank 52 through valve 58 and pipe 64 into the lockhopper 12. The rising water in lockhopper 12 forces the lock gas through the open valve 40 into the separator 36. The pump 56 continues to operate until rising water in lockhopper 12 enters the separator 36 through valve 40 and is detected by the liquid level detector 48. When liquid is detected in the separator 36, a signal is applied to valve controller 50 which causes valve 58 to close and pump 56 to be deactivated. Valve 47 is closed, and valves 30 and 46 are opened to drain any accumulated water in separator 36 back into lockhopper 12. Valve 62 is also opened to allow any water within lockhopper 12 to be drained back into the tank 52 through the inlet 60. When the water has been drained from lockhopper 12, valves 40, 46, and 62 are closed. The lockhopper is ready for another load of coal.

Since the lockhopper 12 is substantially purged of lock gas by the system described above, no significant amount of lock gas leaves the system in the course of depressurization.

Tank 52 is shown with a gas stack 66 through which collected flash gas can be applied to an incinerator or other suitable device.

A single water tank may serve more than one coal gasifier system. For example, a second pump 68, an outlet valve 70 and an inlet valve 72 are illustrated for use in handling lock gas in a second system (not shown). These components would be operated independently of pump 56 and valves 58 and 62 to supply water through a supply pipe 74 to the second coal gasifier system.

While there has been described what is considered to be a preferred embodiment of the invention, it is to be expected that variations and modifications of that embodiment may occur to those skilled in the art once they become acquainted with the basic concepts of the invention. Therefore, it is intended that the appended claims shall be construed to include all such variations and modifications as fall within the true spirit and scope of the invention.

What is claimed is:

1. In a coal gasifier system having a gasifier vessel, a coal lockhopper for receiving coal to be charged into the gasifier vessel and means for pressurizing the lockhopper prior to charging, an improved apparatus for handling lock gas which enters the lockhopper from the gasifier vessel during charging, said apparatus comprising:

a separator having a controllable fluid inlet from said lockhopper, a controllable fluid drain and a gas outlet for removing lock gas from said coal gasifier system;

a liquid storage tank;

pumping means operable at the conclusion of a charging operation for forcing liquid from said storage tank into said lockhopper to drive lock gas through said separator to said gas outlet under pressure; and means responsive to the presence of liquid in said separator to deactivate said pumping means and to open said controllable fluid drain in said separator.

2. An improved apparatus as defined in claim 1, wherein said fluid drain communicates with said storage tank so that liquid drained from said separator is returned to said tank.

3. An improved apparatus as defined in claim 2 wherein said fluid drain is connected to the interior of the lockhopper.

4. An improved apparatus as defined in claim 3, wherein said pumping means includes a pump having an inlet side for receiving a liquid from said storage tank and a discharge side;

a first valve connected in a fluid line on the discharge side of said pump;

a second valve connected in a fluid return line to said storage tank; and a common fluid line connecting one side of each of said first and second valves to said lockhopper.

5. An improved apparatus as defined in claim 4, further including at least one additional pumping means connected to said storage tank.

6. In a coal gasifier system having a gasifier vessel, a lockhopper for receiving coal to be charged into the gasifier vessel and means for pressurizing the lockhopper prior to charging; an improved apparatus for recovering lock gas which enters the lockhopper from the gasifier vessel during charging, said apparatus comprising:

a separator having a fluid inlet from said lockhopper and a gas outlet for removing lock gas from coal gasifier system; and means for flooding said lockhopper with liquid under pressure after a charging operation to force the lock gas through said separator without substantial loss of gas pressure, including means separate from said separator for storing a quantity of said liquid therein and communicating with said lockhopper.

7. In a coal gasifier system having a gasifier vessel, a lockhopper for receiving coal to be charged into the gasifier vessel, means for pressurizing the lockhopper prior to charging, a separator selectively connected to the lockhopper, said separator having a gas outlet for removing lock gas from said coal gasifier system, and a liquid storage tank selectively connected to the lockhopper, an improved method of recovering lock gas which enters the lockhopper from the gasifier vessel during charging, said method including the steps of:

connecting the separator to the lockhopper at the end of a charging operation; and removing the lock gas from the lockhopper by flooding the lockhopper with a liquid from the storage tank under pressure to force the lock gas from the lockhopper through the separator at substantially the extant pressure within the gasifier vessel.

8. An improved method as defined in claim 7 including the additional steps of: terminating the flooding operation upon detection of flooding liquid in the separator; and draining the flooding liquid from the separator and the lockhopper before more coal is loaded into the lockhopper.

9. An improved method as defined in claim 8, wherein the flooding liquid is returned to the liquid storage tank during the draining step.

10. In a coal gasifier system having a gasifier vessel, a lockhopper for receiving coal to be charged into the gasifier and means for increasing the lockhopper pressure to substantially the gasifier pressure, the improvement comprising:

a separator having a controllable fluid inlet from the lockhopper and a gas outlet; for removing lock gas from said coal gasifier system means for flooding said lockhopper with liquid under pressure after a charging operation to force the lock gas through said separator without substantial loss of gas pressure, including means separate from said separator for storing a quantity of said liquid therein and communicating with said lockhopper; and means for maintaining the lock gas pressure at substantially the gasifier pressure level as the lock gas is exhausted from the lockhopper into the separator at the end of a charging operation.

* * * * *